US006289520B1

(12) United States Patent
Page

(10) Patent No.: US 6,289,520 B1
(45) Date of Patent: Sep. 18, 2001

(54) ERGONOMIC UNDERGARMENT HAVING A POUCH FOR RECEIVING MALE GENITALIA

(76) Inventor: Bradley N. Page, 23 Snow Rd., Georgetown, DE (US) 19947

( * ) Notice: Subject to any disclaimer, the term of this patent is extended or adjusted under 35 U.S.C. 154(b) by 0 days.

(21) Appl. No.: 09/688,637

(22) Filed: Oct. 16, 2000

(51) Int. Cl.[7] ..... A41B 9/02
(52) U.S. Cl. ..... 2/403; 2/400
(58) Field of Search ..... 2/400, 69, 403, 2/67, 227, 228, 238, 405; 602/67, 68, 72, 73

(56) References Cited

U.S. PATENT DOCUMENTS

| | | | | |
|---|---|---|---|---|
| 2,328,953 | | 9/1943 | Chatfield et al. . | |
| 2,549,374 | | 4/1951 | Friedman . | |
| 2,601,602 | | 6/1952 | Firsching, Sr. . | |
| 3,517,666 | * | 6/1970 | Atlee | 2/403 |
| 4,173,976 | | 11/1979 | Bloomquist et al. . | |
| 4,759,355 | * | 7/1988 | Thrower | 2/400 |
| 4,955,088 | | 9/1990 | Terjesen . | |
| 4,961,419 | * | 10/1990 | Tribble et al. | 2/400 |
| 5,157,793 | | 10/1992 | Michels . | |
| 5,237,706 | * | 8/1993 | Nalbandian | 2/403 |
| 5,283,912 | * | 2/1994 | Chung | 2/403 |
| 5,598,587 | * | 2/1997 | Wada | 2/403 |
| 5,870,779 | * | 2/1999 | Heron | 2/403 |

* cited by examiner

*Primary Examiner*—Gloria M. Hale
(74) *Attorney, Agent, or Firm*—Emery L. Tracy

(57) ABSTRACT

A garment assembly for covering the genitalia of a male user is provided. The user having a perineum adjacently beneath the genitalia. The garment assembly comprises a front panel member positionable adjacently over the genitalia with the front panel having a top edge, a bottom edge, a first side edge and a second side edge. A suspending mechanism suspends the front panel adjacently over the genitalia with the top edge and the bottom edge being secured to the suspension means. A fold is formed in the first side edge and the second side edge and extends across the front panel member. The fold creates a genital-receiving pouch in the front panel wherein the fold is positionable over the perineum of the user such that the front panel is free from forward and upward pressure on the genitalia.

15 Claims, 3 Drawing Sheets

ERGONOMIC UNDERGARMENT HAVING A POUCH FOR RECEIVING MALE GENITALIA

BACKGROUND OF THE INVENTION

1. Field of the Invention

This invention relates generally to undergarments and activewear and, more particularly, it relates to undergarments and activewear having a pouch for receiving the male genitalia of a male user.

2. Description of the Prior Art

Men's undergarments that are referred to as briefs are generally constructed to conform snugly to body contours. Additionally, it is known in the prior art to provide a suspensory pouch in the undergarment for support of the male genitalia. The suspensory pouch creates room for the genitalia by forming an arcuate front-center seam from the perineum up the front panel of the undergarment. While the undergarments of the prior art typically provide comfort and support when the wearer is standing, the support behind the scrotum creates pressure and often becomes uncomfortable during active movement or when sitting or crouching, especially for prolonged periods. Even an extreme arcuate seam does not easily conform to the acute angle created by the perineum and the back of the scrotum.

Additionally, the prior art pouch structures, while providing adequate support, are not cut to provide comfortable fit and to allow for body movement. The wearer may thus experience some discomfort by assuming a position in which the undergarment has a tendency to pinch the body or apply pressure to the body.

Accordingly, there exists a need for a genitalia receiving pouch for undergarments and activewear that entails a suspensory pouch formed by a convex arcuate center seam in the front panel to conform to the contours of the male anatomy. Additionally, a need exists for a genitalia receiving pouch for undergarments and activewear that honors the natural contours of the male anatomy by providing AREAmaterial at the juncture of the perineum and scrotum that creates a soft fold so that the material behind the scrotum exerts neither forward nor upward pressure on the scrotum and testicles regardless of posture or movement. Furthermore, there exists a need for a genitalia receiving pouch for undergarments and activewear that creates a soft fold and acts as a baffle which can unfold to an extended position to provide more material and maintain comfort in extreme movement and postures.

SUMMARY

The present invention is a garment assembly for covering the genitalia of a male user with the user having a perineum adjacently beneath the genitalia. The garment assembly comprises a front panel member positionable adjacently over the genitalia with the front panel having a top edge, a bottom edge, a first side edge and a second side edge. A suspending mechanism suspends the front panel adjacently over the genitalia with the top edge and the bottom edge being secured to the suspension means. A fold is formed in the first side edge and the second side edge and extends across the front panel member. The fold creates a genital-receiving pouch in the front panel wherein the fold is positionable over the perineum of the user such that the front panel is free from forward and upward pressure on the genitalia.

The present invention additionally includes an undergarment for a male user. The undergarment comprises pouch means for receiving the genitals of the male user and fold means formed in the pouch means, the fold means positionable below the genitals.

The present invention further includes a method for covering the genitals of a male user with the male user having a perineum beneath the genitals. The method comprises providing a pouch about the genitals, the pouch having a width, creating a folded portion by folding the pouch across the width, and positioning the folded portion adjacent the perineum beneath the genitals.

DETAILED DESCRIPTION OF THE PREFERRED EMBODIMENTS

Figure 1:
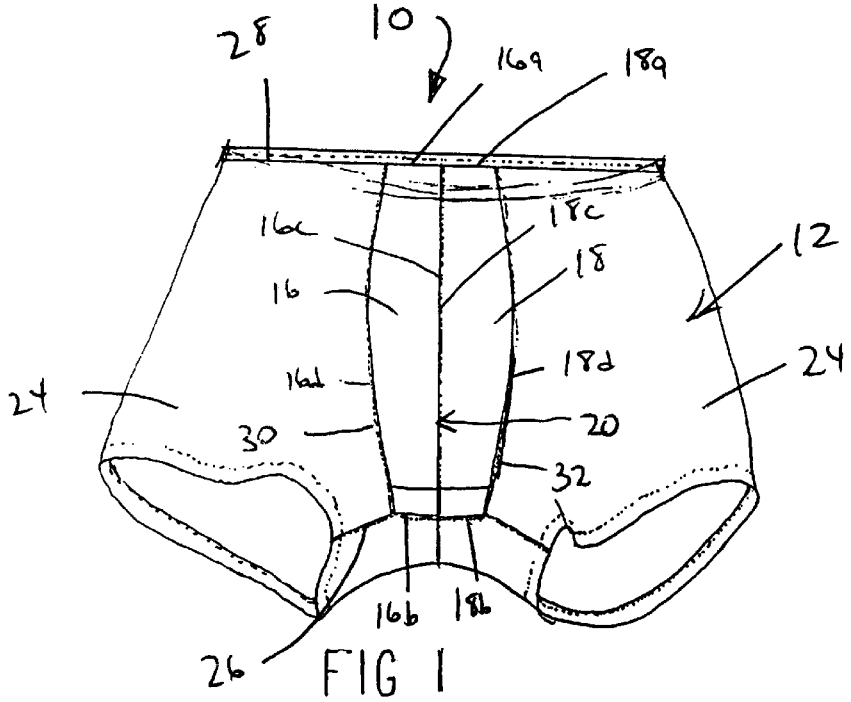
FIG. 1 is a front view illustrating an ergonomic undergarment having a pouch for receiving male genitalia, constructed in accordance with the present invention, with the front waist band moved way to illustrate crotch seams, leg openings, and underside of pouch.
Figure 2:
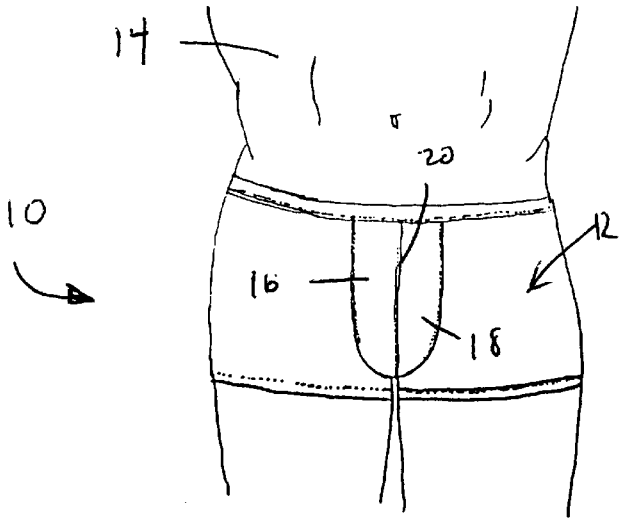
FIG. 2 is a front elevational view illustrating the ergonomic undergarment having a pouch for receiving male genitalia, constructed in accordance with the present invention, with the undergarment being worn by a male user.
Figure 3:
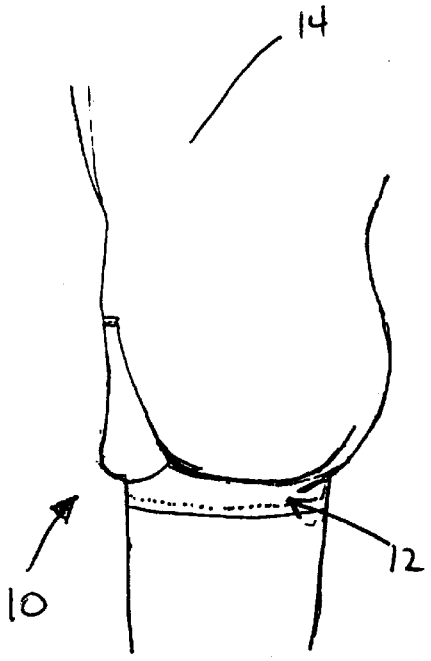
FIG. 3 is a sagittal side elevational view illustrating the ergonomic undergarment having a pouch for receiving male genitalia, constructed in accordance with the present invention, with the undergarment being worn by a male user.
Figure 4:
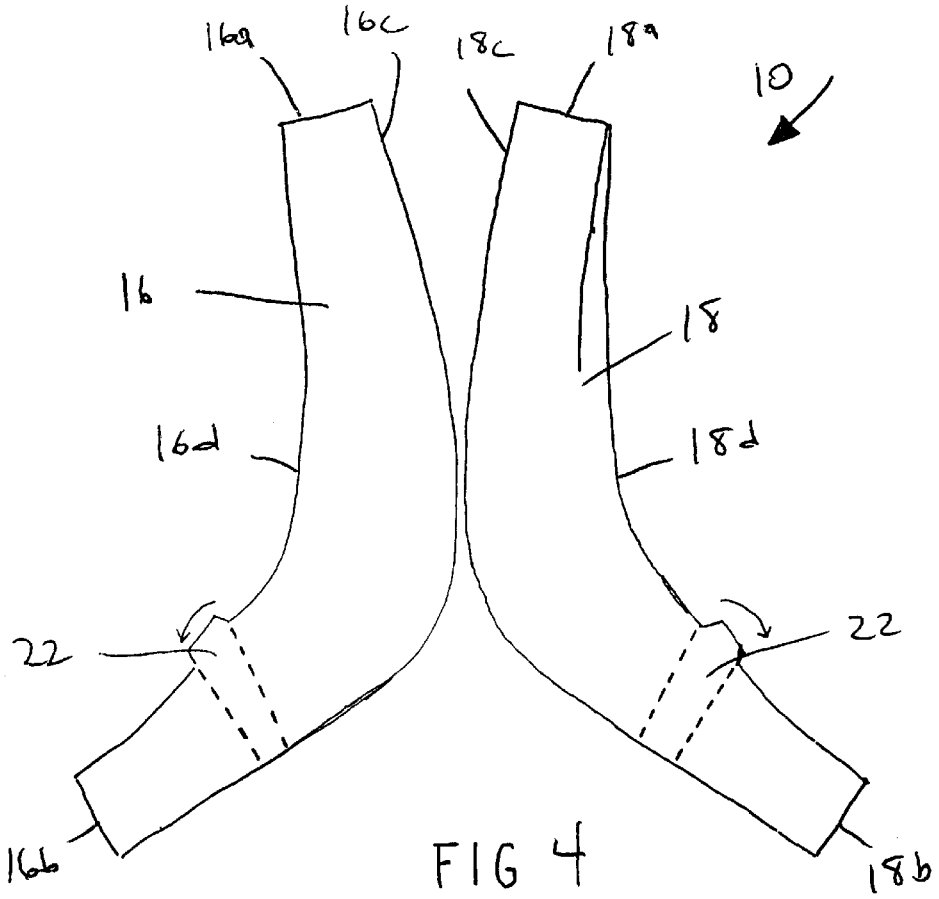
FIG. 4 is in elevational side view illustrating a front panel of the ergonomic undergarment, constructed in accordance with the present invention, having a first member and a second member for creating a pouch for receiving male genitalia.
Figure 5:
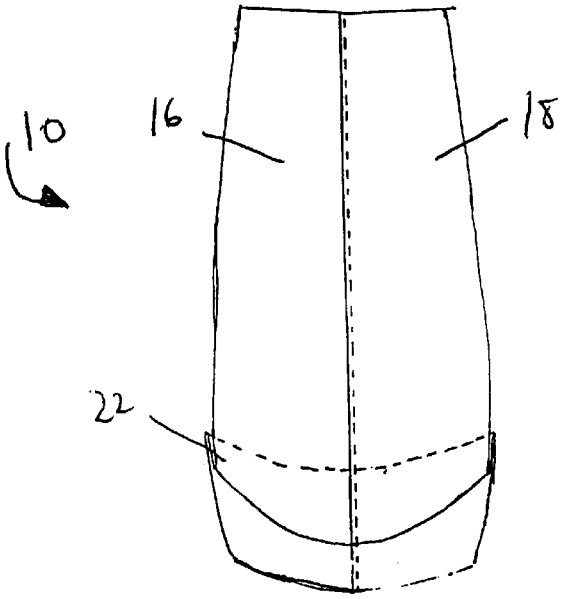
FIG. 5 is a front elevational view illustrating the front panel of the ergonomic undergarment, constructed in accordance with the present invention, with the first member being joined to the second member by a center seam creating a pleat.
Figure 6:
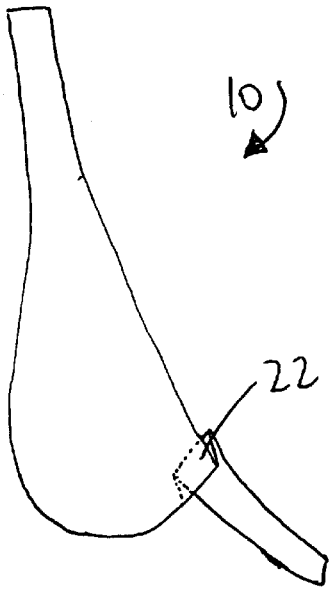
FIG. 6 is a side elevational view illustrating the front panel of the ergonomic undergarment, constructed in accordance with the present invention.

As illustrated in FIGS. 1–6, the present invention is a front panel/pouch, indicated generally at 10, for undergarments 12 and the like for supporting the genitals (not shown) of a male user 14 (see FIG. 2). While the front panel/pouch 10 of the present invention will be described herein and hereafter as being suitable for undergarments 12, a person skilled in the art will understand that the front panel/pouch 10 is not limited to undergarments 12, but can also be utilized on long pants, shorts, athletic pants and shorts, swimming suits, exercise pants and shorts, etc.

The front panel/pouch 10 of the present invention includes a first panel portion 16 and a second panel portion 18. Both the first panel portion 16 and the second panel portion 18 have a top edge 16*a*, 18*a*, a bottom edge 16*b*, 18*b*, a first side edge 16*c*, 18*c*, and a second side edge 16*d*, 18*d*. The first side edge 16*c* of the first panel portion 16 is attached to the first side edge 18*c* of the second panel portion 18 by stitching or the like thereby creating an arcuate center seam 20. The second side edges 16*d*, 18*d* have pleats 22 which reverse the direction of the front panel/pouch 10 in a soft fold that combines with the arcuate center seam 20 to create the front panel/pouch 10 for the male genitals. The pleat 22 is formed such that upon wearing the undergarment 12 with the front panel/pouch 10 of the present invention, the pleat 22 is positioned at the juncture of the perineum (not shown) and the scrotum (not shown) of the male user 14.

Figure 7:
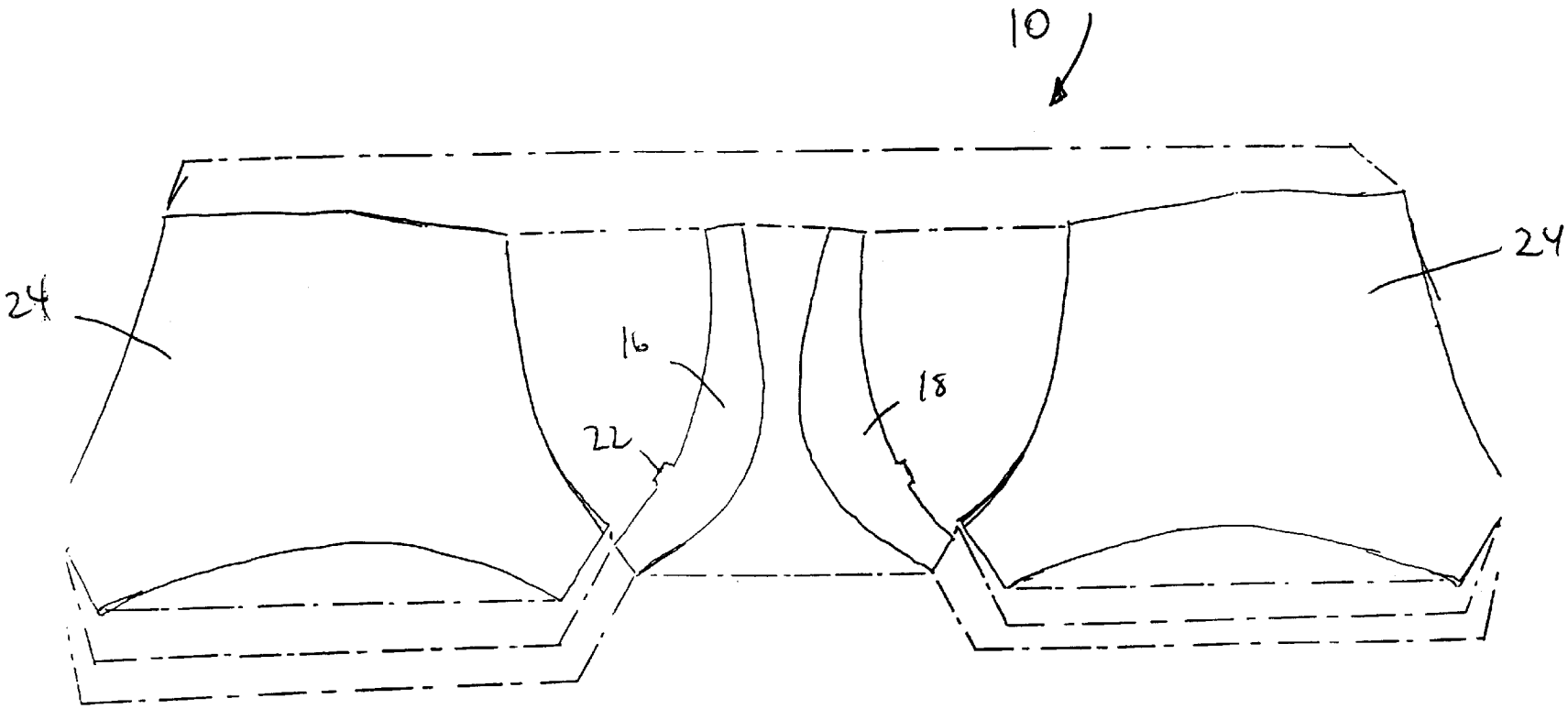
FIG. 7 is a front view illustrating the first member and the second member of the front panel of the ergonomic undergarment, constructed in accordance with the present invention.

As illustrated in FIG. 7, the front panel/pouch 10 is then incorporated into the undergarment 12 or other garment, as mentioned above. Depending on the design of the garment 12, the garment 12 will have a hip/seat/pant panel 24 comprising of a single or plurality of panels. The hip/seat/pant panel 24 has a bottom edge 26 to form a crotch seam, a top edge 28 which forms part of (or attaches to) the waistband, a first leading hip edge, 30, and a second leading hip edge 32 to form inguinal seams from groin to waist. If the garment 12 is a short or pant design, preferably, the hip/seat/pant panel 24 has left and right pant edges that extend from the back-crotch portion of the panel and left and right pant edges that extend from the hip-crotch portion of panel to form the inseams of the garment 12.

To construct the front panel/pouch 10 of the present invention, the bottom edge 16*b*, 18*b* of the first panel portion 16 and the second panel portion 18 is attached to the bottom edge 26 of the hip/seat/pant panel 24 forming a crotch seam at the crotch of the male user 14. The second side edges 16*d*, 18*d* of the first panel portion 16 and the second panel portion 18 are attached to the first leading hip edge 30 and the second leading hip edge 32, respectively, of the hip/seat/pant panel 24 forming inguinal seams extending substantially vertically from the groin to the waist of the male user 14. The first pant edge that extends from back-crotch is sewn to the first pant edge that extends from hip-crotch to form the left inseam of the pant. The second hip and back pant edges are similarly joined to form the right inseam of the pant.

For "brief"-type designs there are no pant edges and the bottom edge 16*b*, 18*b* of the first panel portion 16 and the second panel portion 18 form part of the leg opening of the garment 12. In all designs the top edges 16*a*, 18*a* of the first panel portion 16 and the second panel portion 18 and hip/seat/pant panel 24 form (or attach to) a waistband according to the design of the garment 12.

Preferably, the front panel/pouch 10 is constructed from the same material as the remainder of the garment 12. It is within the scope of the present invention, however, to construct the front panel/pouch 10 from a material which is different than the remainder of the garment 12.

The present invention is a simple and novel improvement in the art of men's undergarments and active wear. By adding the pleat 22 to the front panel/pouch 10 at the juncture of the perineum and scrotum, the front panel/pouch 10 creates a true pouch that moves down behind and under the genitals of the male user 14. The tacking of the pleats 22 at the inguinal seams keeps the lines neat, while the soft fold of the pleat 22 at the centerline functions as a baffle that provides extra material when needed in extreme movement and postures. Because the adaptations of the front panel/pouch 10 of the present invention are actually behind the genitalia, no change is necessary in the lines and style of designs that already incorporate arcuate center seams in the front panel. The front panel/pouch 10 can be incorporated providing all the benefits of snug fitting clothing with the comfort previously only found in "boxer"-type or baggy garments. A stay stitch of lightweight material can be used to give the front panel/pouch 10 more body.

The present invention eliminates the disadvantage of prior art by providing a garment 12 that honors the natural contours of the male anatomy—the material at the juncture of the perineum and scrotum create a soft fold so that the material behind the scrotum exerts neither forward nor upward pressure on the scrotum and testicles regardless of posture or movement.

Furthermore, the pleat design of the present invention offers a secondary benefit. While the material of the piece at the seam with the hip edges is fastened in place, the pleat 22 at the center arcuate seam 20 creates a soft fold and acts as a baffle which can unfold to an extended position to provide more material and maintain comfort in extreme movement and postures.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A garment assembly for covering the genitalia of a male user, the user having a perineum adjacently beneath the genitalia, the garment assembly comprising:

a front panel member positionable adjacently over the genitalia, the front panel having a top edge, a bottom edge, a first side edge and a second side edge;

suspension means for suspending the front panel adjacently over the genitalia, the top edge and the bottom edge being secured to the suspension means; and a fold formed in the first side edge and the second side edge and extending across the front panel member, the fold creating a genital-receiving pouch in the front panel;

wherein the fold is positionable over the perineum of the user such that the front panel is free from forward and upward pressure on the genitalia.

2. The garment assembly of claim 1 wherein the front panel member includes a first panel portion and a second panel portion, the first panel portion and the second panel portion having a top edge, a bottom edge, a first side edge, and a second side edge with the first side edge of the first panel portion being attached to the first side edge of the second panel portion.

3. The garment assembly of claim 2 wherein the first panel portion is connected to the second panel portion by stitching.

4. The garment assembly of claim 2 wherein the joined first side edges of the first panel portion and the second panel portion form an arcuate center seam.

5. The garment assembly of claim 1 wherein the fold includes a first fold line and a second fold line, the front panel extending toward the top edge between the first fold line and the second fold line.

6. The garment assembly of claim 1 wherein the suspension means is selected from the group consisting of long pants, shorts, athletic pants, athletic shorts, swimming suits, exercise pants, and exercise shorts.

7. An undergarment for a male user the male user having genitals, the undergarment comprising:

pouch means for receiving the genitals of the male user, the pouch means having a front panel member having a top edge, a bottom edge, a first side edge, and a second side edge, the front panel member includes a first panel portion and a second panel portion, the first panel portion and the second panel portion having a top edge, a bottom edge, a first side edge, and a second side edge with the first side edge of the first panel portion being attached to the first side edge of the second panel portion; and fold means formed in the pouch means, the fold means positionable below the genitals.

8. The undergarment of claim 7 wherein the first panel portion is connected to the second panel portion by stitching.

9. The undergarment of claim 7 wherein the joined first side edges of the first panel portion and the second panel portion form an arcuate center seam.

10. The undergarment of claim 7 wherein the fold means includes a first fold line and a second fold line, the pouch means reversing direction between the first fold line and the second fold line.

11. An undergarment for a male user the male user having genitals, the undergarment comprising:

pouch means for receiving the genitals of the male user; and fold means formed in the pouch means, the fold means positionable below the genitals, the fold means having a first fold line and a second fold line, the pouch means reversing direction between the first fold line and the second fold line.

12. The undergarment of claim 11 wherein the pouch means includes a front panel member having a top edge, a bottom edge, a first side edge and a second side edge.

13. The undergarment of claim 12 wherein the front panel member includes a first panel portion and a second panel portion, the first panel portion and the second panel portion having a top edge, a bottom edge, a first side edge, and a second side edge with the first side edge of the first panel portion being attached to the first side edge of the second panel portion.

14. The undergarment of claim 13 wherein the first panel portion is connected to the second panel portion by stitching.

15. The undergarment of claim 13 wherein the joined first side edges of the first panel portion and the second panel portion form an arcuate center seam.

* * * * *